United States Patent [19]

Weaver et al.

[11] Patent Number: 4,955,676

[45] Date of Patent: Sep. 11, 1990

[54] REFRIGERATOR MULLION CONSTRUCTION

[75] Inventors: Douglas E. Weaver; Harold S. Mawby, both of Greenville, Mich.

[73] Assignee: White Consolidated Industries, Inc., Cleveland, Ohio

[21] Appl. No.: 400,284

[22] Filed: Aug. 29, 1989

[51] Int. Cl.[5] ..... A47B 81/00

[52] U.S. Cl. ..... 312/214; 312/236

[58] Field of Search ..... 312/236, 214

[56] References Cited

U.S. PATENT DOCUMENTS

| | | | |
|---|---|---|---|
| 3,834,779 | 9/1974 | Turner et al. | 312/214 |
| 4,550,576 | 11/1985 | Tate et al. | 62/441 |
| 4,558,503 | 12/1985 | Wilson | 312/214 X |
| 4,606,112 | 8/1986 | Jenkins et al. | 312/214 X |
| 4,632,470 | 12/1986 | Jenkins et al. | 312/214 |
| 4,706,363 | 11/1987 | Taylor | 312/214 X |
| 4,765,696 | 8/1988 | Cordill et al. | 312/214 |
| 4,801,181 | 1/1989 | Cordill et al. | 312/214 |
| 4,821,399 | 4/1989 | Markley et al. | 312/214 X |

*Primary Examiner*—Joseph Falk

*Attorney, Agent, or Firm*—Pearne, Gordon, McCoy & Granger

[57] ABSTRACT

A refrigerator has upper and lower compartments each closed by separate doors mounted on the cabinet and separated from each other by a partition. At the front of the partition is a mullion assembly including a mullion cover arranged flush with the front face of the cabinet and behind the mullion cover is a mullion strap having end portions at each end projecting beyond the mullion cover behind the front face of the cabinet where screws clamp the mullion strap ends to the rear of the front face of the cabinet to provide a brace between the two sides of the cabinet and another set of screws secure the mullion cover to the mullion strap adjacent each end. The mullion strap has a flat center section for flexibility during assembly, while each end portion is in the form of a forward opening channel which forms a box construction with the mullion cover. The flanges of the channel have projecting serrations arranged to penetrate the finish and providing grounding contact between the mullion strap and both the mullion cover and the shell. The two screws at each end also serve to mount a hinge bracket which serves as the lower hinge for the upper door and the upper hinge for the lower door.

12 Claims, 5 Drawing Sheets

REFRIGERATOR MULLION CONSTRUCTION

BACKGROUND OF THE INVENTION

This invention relates generally to refrigerator cabinets, and more particularly to cabinets for refrigerators having two compartments, one above the other, separated by a partition.

A common arrangement for a household refrigerator provides two separate compartments, one above the other, in which the upper compartment usually serves as a frozen food compartment, while the lower compartment is maintained at a temperature slightly above freezing for best preservation of fresh foods. Each of these compartments has its own door mounted on hinges secured to the cabinet, and has a magnetic sealing gasket around its periphery which must engage with a smooth magnetic surface around each of the separate food compartments. Because of space considerations, such refrigerators are built in the form of a rectangular box having a height that is more than twice the width of the cabinet, while the freezer compartment has a volume of approximately half the volume of the fresh food compartment.

A common construction for refrigerators of this type is to use a relatively thin metal outer shell forming the exterior surfaces of the cabinet and this shell forms a flange around the front face to provide for engagement with the sealing gaskets carried by the doors. The interior is formed from a one-piece liner thermoformed from a sheet of thermoplastic. The liner has a peripheral flange at the front edge and the liner is mounted within the shell by the flange which seats into a groove on the shell directly behind the front face. When the space between the liner and the shell is filled with an insulating, rigid foam, such as polyurethane foam, the result is a generally rigid and strong cabinet because of the sandwich construction even though the shell and the liner, by themselves, may not have a great deal of rigidity.

To separate the two compartments a partition, which includes insulating material, is mounted in the liner and generally held in place vertically by projecting horizontal ribs or grooves formed within the liner so that the partition can be supported around the three sides in engagement with the cabinet liner. This arrangement requires the use of a mullion assembly which extends between the two sides of the shell in line with the partition, and which provides a plurality of functions, including those of holding the partition in place, providing a tension strap between the opposed sides of the cabinet to prevent them from bowing outwardly, providing a finished surface for seating of the magnetic gaskets along the adjacent door edges, and for providing a strong mount for a hinge assembly bracket which provides the lower hinge point for the upper door and the upper hinge point for the lower door.

The mullion construction used for these refrigerators generally includes at least a mullion cover fabricated from the same material as that used for the shell to provide uniformity of appearance, together with a supporting structure to provide a mounting for the mullion cover and the other structural requirements of the refrigerator cabinet. A particular problem with this mullion support structure is that it must be firmly anchored at each end to the cabinet shell to give the structure sufficient strength and rigidity in tying together the side walls and providing the necessary support for the hinge bracket, which is generally so constructed that it may be mounted on either side to provide for reversibility of the refrigerator doors.

One particular problem on the mounting of the support structure is that the actual opening into the interior of the refrigerator is determined by the width between the edges of the faces on the cabinet shell. Thus, these faces are made as narrow as possible, but a certain minimum width must be maintained, since it is necessary that the mullion support make engagement with or be fastened to portions of the shell behind the front face. One approach to thIs is to mount suitable support brackets on the shell prior to the foaming operation so that their brackets are embedded in the foam. These brackets can then provide a mounting for the mullion support assembly that is no longer than the width between the edges of the cabinet face. Such arrangements are shown in U.S. Pat. Nos. 4,550,576; 4,765,696; and 4,801,181.

Another approach as shown in U.S. Pat. Nos. 4,606,112; 4,632,470; and 4,706,363 is to use a mullion support strap that is formed in two pieces with an overlapping or telescoping joint at the center which allows the mullion support strap to be shortened for insertion behind the front face, after which it can be lengthened so that each end hooks behind the front face of the shell for attachment to the shell or a recessed bracket, after which the two pieces of the mullion support are firmly secured together by clamping bolts at the connection.

A particular problem with both of the above approaches is that because they require a plurality of parts, some of which may have to be installed prior to the foaming operation and some after it, the multiplicity of parts and labor to install them results in a rather high-cost construction.

Another approach has been to use a mullion support strap that is flat and is able to flex in a horizontal plane so that the center may be bowed out to shorten the distance between the ends so that it may be slipped behind the edges of the front face of the cabinet shell, and afterwards secured in place. One such arrangement is shown in U.S. Pat. No. 4,558,503, and a study of this patent shows the difficulties in assembling this type of arrangement.

Another approach has been used over a period of time by the assignee of the present application, in which a flat strap of relatively thick steel was inserted after the partition was assembled within the liner by bowing out the center section of the strap and inserting each of the ends into the groove holding the liner flange in front of the liner flange so that its front face abuts directly against the re-entrant folded wall of the shell directly behind the front face. A screw then extends through a hole in the front face and the reentrant flange to make threaded engagement directly with a threaded opening on the strap. The mullion face is then attached directly to the strap by means of a screw at each end of the face extending through the mullion face and threadedly engaging the support strap. On the side of the refrigerator on which the doors are to be hinged, the same two screws are also used to mount a hinge support bracket that serves as the lower hinge for the upper door and the upper hinge for the lower door. While this arrangement provides sufficient tensile strength to prevent the edges or sides of the cabinet shell from bowing outwardly, it tends to allow excessive flexing of the hinge support bracket, since the support strap must be thin enough to allow sufficient flexing during assembly.

SUMMARY OF THE INVENTION

The present invention provides an improved mullion support strap for providing greater rigidity for the mullion assembly, particularly to provide additional rigidity for the hinge bracket as well as to better ensure electrical grounding of all of the component parts.

According to the preferred embodiment of this invention the mullion structure includes a mullion support strap and a mullion face or cover which is formed of the finished material of the cabinet and is located to be coplanar with the shell front face to provide a seating surface for the door gaskets. The mullion support strap is formed with a flat center section which permits the support strap to be flexed at this point for insertion in the cabinet after the partition has been mounted in place. The support strap is longer than the width of the opening between the edges of the front face of the cabinet shell so that each end of the support strap can fit within the groove formed in the shell behind the front face for receiving the peripheral flange on the plastic liner.

On each side of the flat center section, the support strap is formed with edges folded at 90 degrees and extending forward toward the mullion plate, thus defining a channel which, when covered by the mullion plate, will form a closed box for maximum rigidity. The bent edges of the channel extend from the center section to the extreme ends of the support strap while the end portion is slightly offset to accommodate the thickness of the reentrant flange on the shell forming the front side of the groove. At each end, the support strap has a hole in the center for receIving a clamping screw which extends through the front face and the reentrant flange to make threaded engagement with the support strap to tightly secure the support strap to the shell at each side.

A spaced distance centerward from this hole is another hole in the support strap which receives a screw extending through a hole of the mullion cover plate to securely hold the two pieces together, and these two screws at one side also provide the sole mounting attachment for a hinge bracket to form part of the hinge assembly for the upper and lower doors. In addition, the inturned lips of the support strap adjacent the locations of each of the two holes at each end are formed with teeth or serrations designed, when the screws are fully tightened, to bite through any paint or other coating on the shell and mullion support plate to make a grounding contact to ensure that both the mullion cover plate and the mullion support strap are electrically grounded to the cabinet shell.

DETAILED DESCRIPTION OF THE PREFERRED EMBODIMENT

Figure 1:
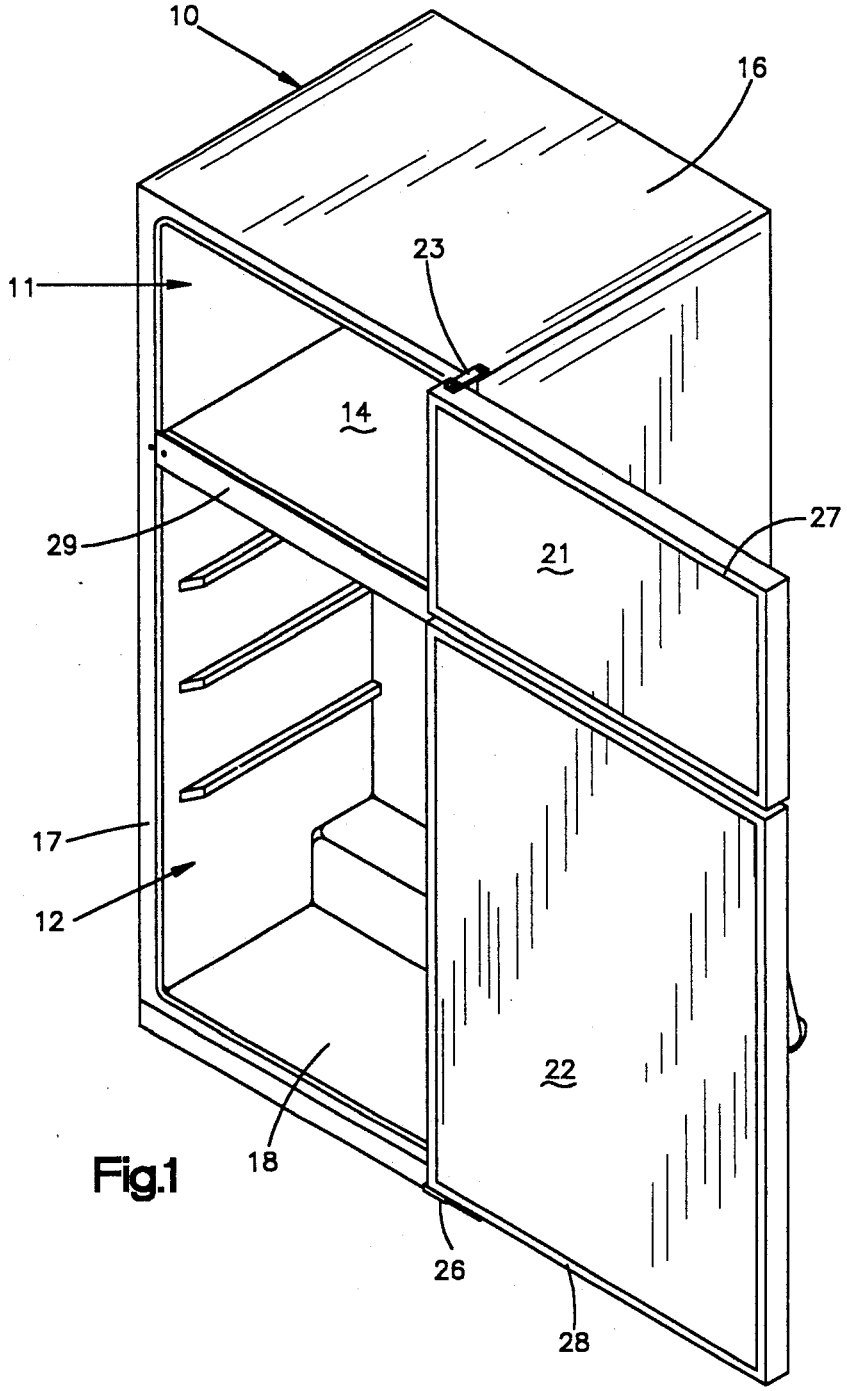
FIG. 1 is a schematic, perspective view of a refrigerator having a top freezer compartment with the doors open and incorporating the present invention.
Figure 2:
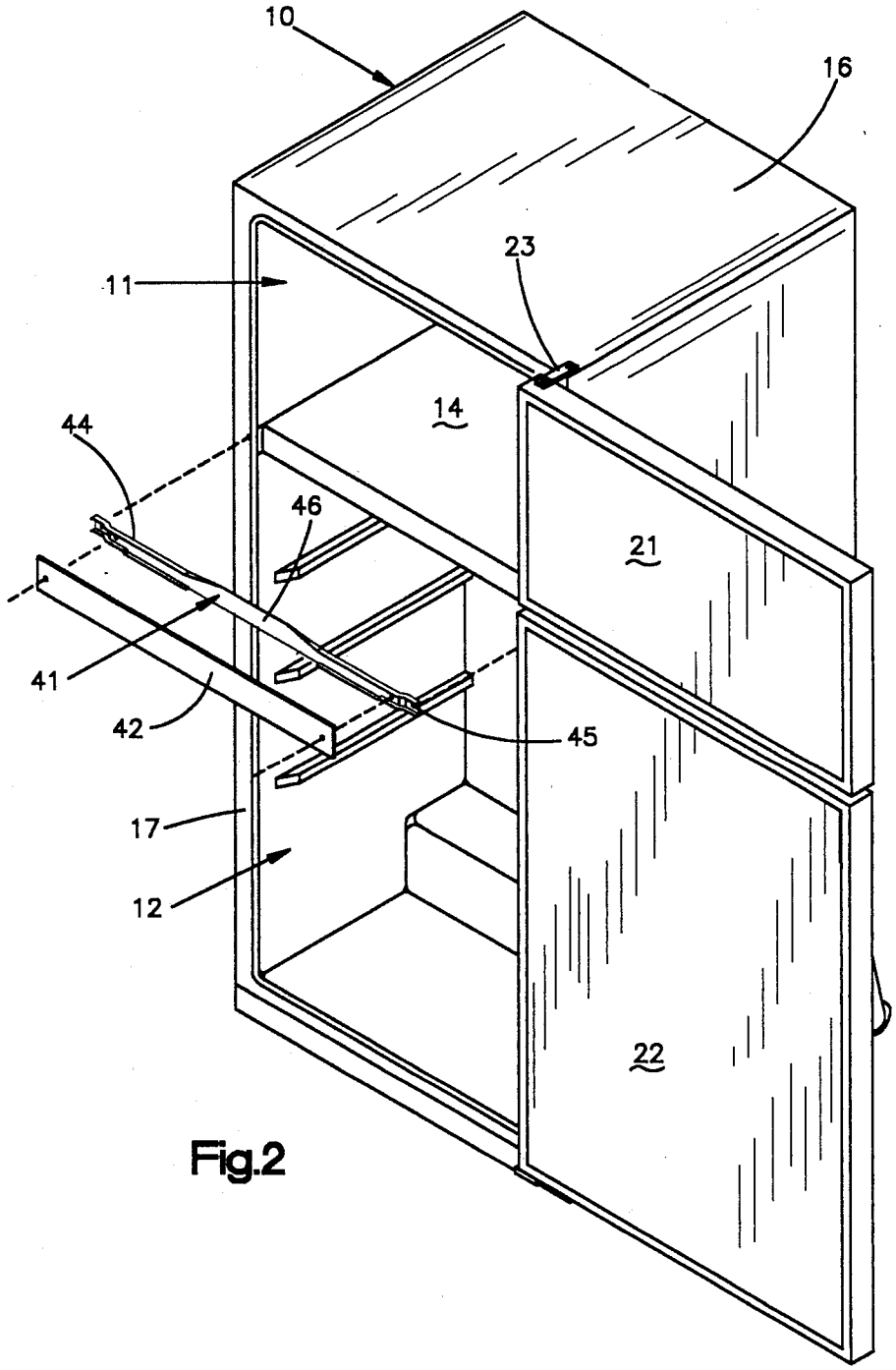
FIG. 2 is a view similar to FIG. 1, but with the mullion structure components exploded away.

Referring to the drawings in greater detail, FIGS. 1 and 2 show a typical two-door top freezer refrigerator 10 having a top freezer compartment 11 in the upper portion and a bottom food compartment 12 directly below it and separated from it by a horizontal partition 14. The refrigerator 10 comprises a metal outer shell 16 extending around at least the top wall and two side walls of the refrigerator, and the front edges of these walls are extended and bent inwardly through a 90-degree angle to form a flat front face 17. A liner 18 forming the inner surface of the freezer and food compartments 11 and 12 is mounted within the shell 16 and spaced from the shell by the conventional polyurethane foam insulation which bonds to the shell and liner to form an integral unit. A top or freezer door 21 is mounted to close off the freezer compartment 11, while a bottom or food compartment door 22 is mounted directly below it to close off the food compartment 12. To mount the doors 21 and 22, a top hinge bracket 23 is fastened to the top wall of shell 16 to form the upper bearing for the freezer door, while a middle hinge bracket 25 (see FIGS. 4 and 5) serves as both the bottom hinge for the top door 21 and the top hinge for the bottom door 22. A bottom hinge bracket 26 is mounted on shell 16 below the bottom door 22 and serves as the bottom hinge and to support the weight of the food compartment door 22. Each of the doors 21 and 22 has a peripheral gasket 27 and 28, respectively, which is adapted to seal against the shell front face 17 to close off the compartments from the exterior, and both doors require that the gaskets 27 and 28 also make sealing engagement with a mullion member 29 to complete the sealing of each of the compartments.

Figure 6:
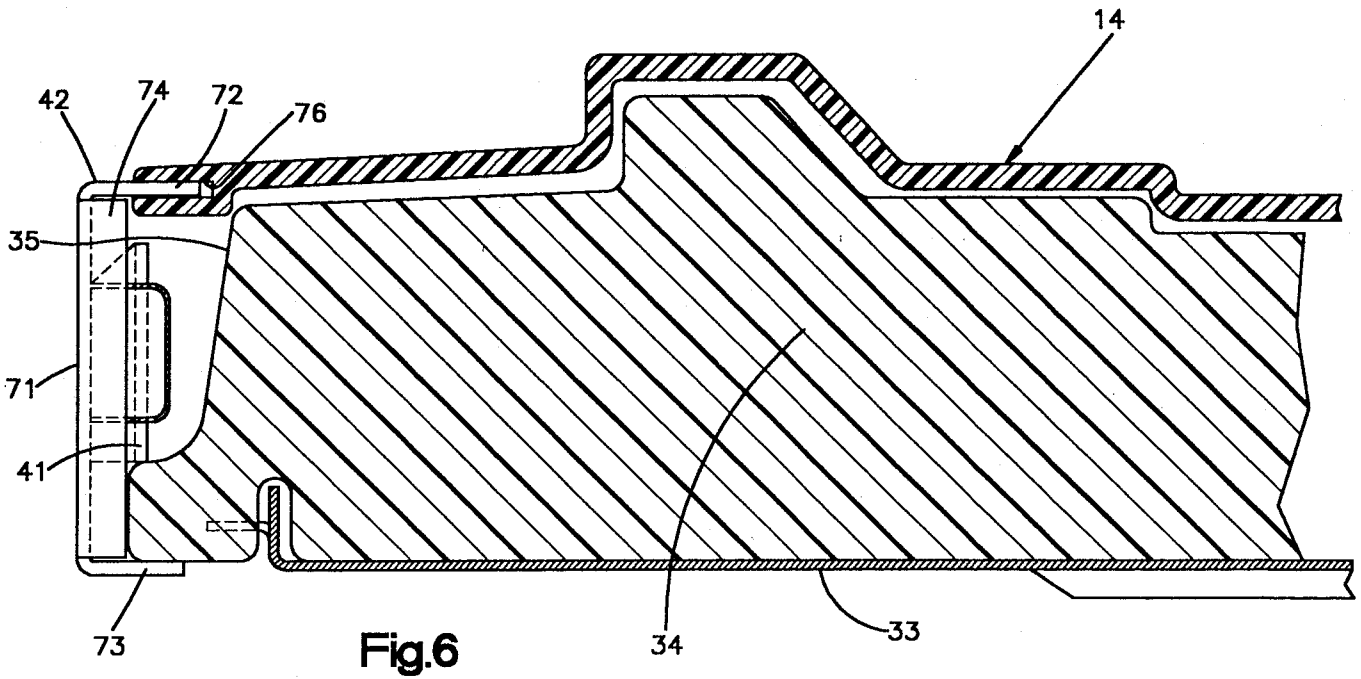
FIG. 6 is a cross-sectional view taken along line 6—6 of FIG. 5.

The partition 14 between the compartments 11 and 12 is assembled from a freezer bottom panel 31 (see also FIG. 6) which is preferably formed from a suitable plastic material and a food compartment top 33, preferably formed from sheet metal, on the lower side. The panels 31 and 33 are separated by an insulation member 34 which may also be formed from a foamed plastic such as polystyrene, and defines a front face 35 in alignment with the mullion member 29. It will be understood that the partition 14 may also include various air passages and other structural features, and suitable fasteners extend between the freezer bottom 31 and food compartment top panel 33 to hold the three members together as a unitary assembly. Partition 14 is movable, and may be assembled by sliding it into place, where it is supported by lower and upper ribs 36 and 37 formed on the side walls of the liner 18 and spaced by lower and upper grooves 38 and 39 which receive projections on the panels 33 and 31, respectively.

The mullion member 29 includes a support strap 41 which serves as a rigid structural member tying together the sides of the shell 16, as well as holding the partition 14 in place. Mullion member 29 also includes a mullion cover 42 which provides a finished surface positioned to be coplanar with the front face 17 of shell 16, and which is secured to the mullion strap 41, as will be described in greater detail hereinafter.

Figure 3:
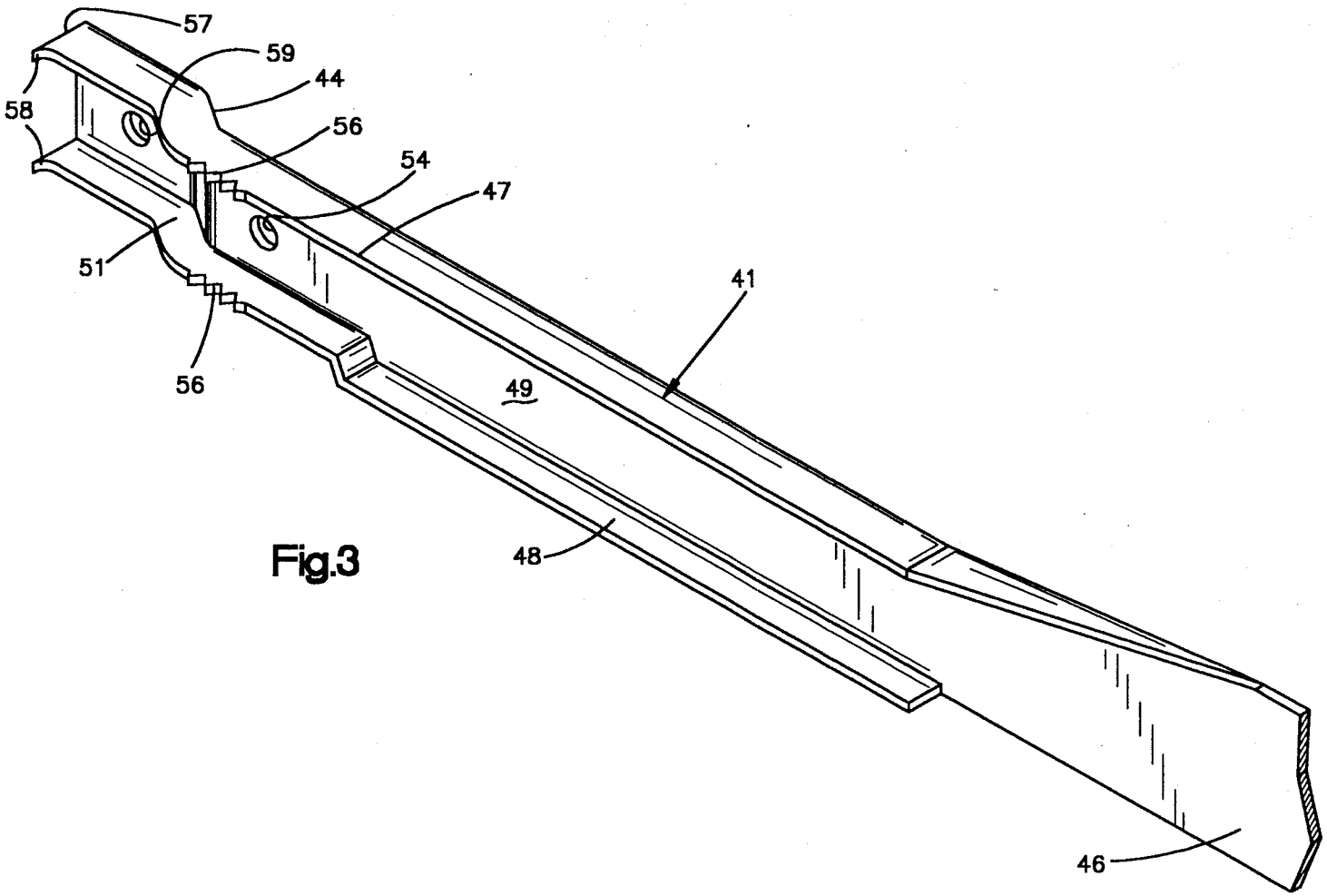
FIG. 3 is an enlarged, perspective view of one end of the mullion support strap shown in FIG. 2.

The mullion strap 41 has a length greater than the width of the opening provided between the side edges of the front face 17 of shell 16, which is necessary to have each end extend behind the face to receive fasteners, as described hereinafter. Therefore, the strap must be made flexible to allow it to be bent in a horizontal plane to draw the two ends closer together so that it may be inserted in place after the partition 14 has been placed in the liners. Accordingly, the strap 41, which is preferably made from relatively heavy gauge galvanized steel, has left and right ends 44 and 45 which are mirror images of each other and join a flat and flexible center section 46 (see FIGS. 2 and 3) which defines the zone in which the flexing takes place during assembly. At each of the ends 44 and 45, the support strap is provided with forwardly extending, upper and lower flanges 47 and 48 extending forwardly from a center web portion 49 which is a planar extension of the flat center section 46. Adjacent each of the ends, the mullion strap has offsets at 51 and 52 in which both the flanges 47 and 48 and the web portion 49 are offset to the rear to allow the end portions to fit behind the portions of the shell while leaving the central portion between the two offsets close to the plane of the front face 17.

At each end, an inner hole 54 is formed in the web portion 49 inwardly of the offsets 51 and 52 and in this zone the edges of the flanges 47 and 48 are formed with sharp toothlike serrations 56. At each end beyond the offsets 51 and 52, the web portion 49 has an outer hole 59, while the ends 57 of the flanges 47 and 48 are each formed with a sharp, forwardly extending spur 58. The serrations 56 and the spurs 58 are intentionally made as sharp as possible so that when the mullion is fully assembled, the sharp edges will cut through the paint or other finish on both the mullion cover 42 and the shell 16 to provide positive electrical grounding contact through the body of the support strap 41.

Figure 5:
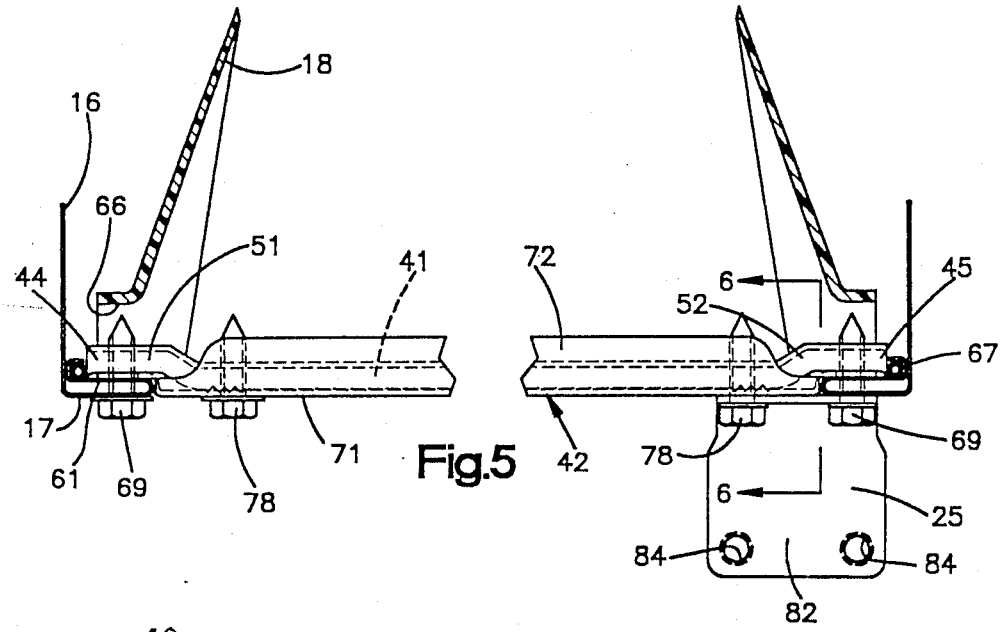
FIG. 5 is a cross-sectional view taken along line 5—5 of FIG. 4
Figure 4:
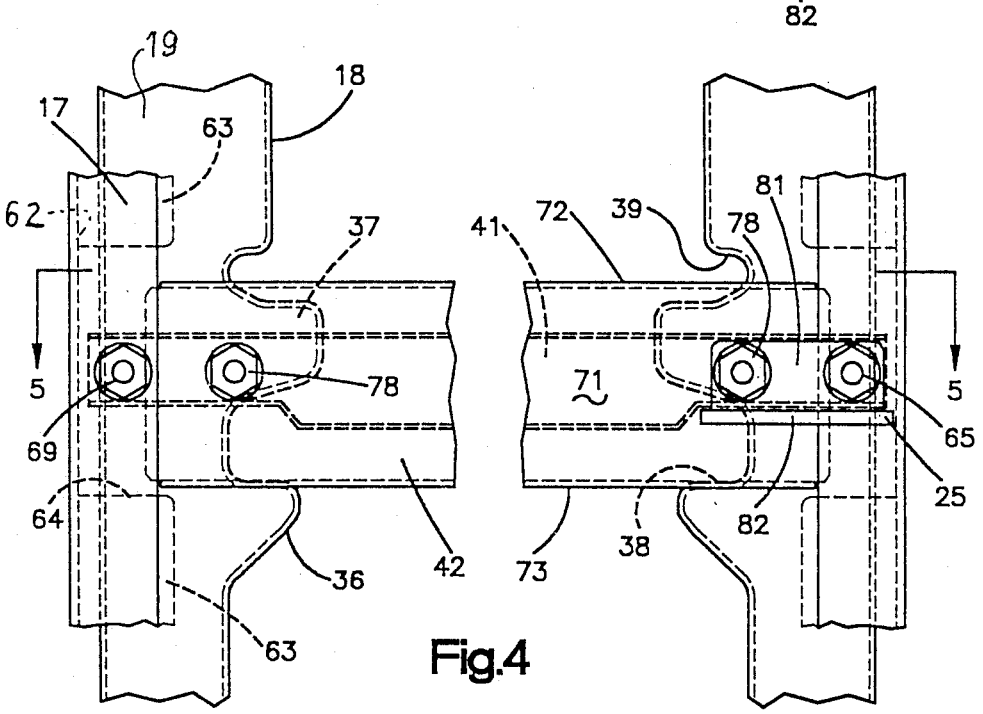
FIG. 4 is a fragmentary, elevational view, with parts broken away and the partition removed, showing the mullion structure according to the preferred embodiment of this invention.

During the assembly process, the partition 14 is first inserted in place in the liner 18, where it is positioned vertically by the ribs 36 and 37, as well as other ribs (not shown) formed on the back wall of the liner. The support strap is then mounted in place by inserting one end behind the shell and, while bending the strap in the flat center section 46, the distance between the strap ends is shortened enough to allow the other end to be inserted in place. As shown in FIGS. 4 and 5, the shell 16 has a reentrant flange 61 which is bent through a 180-degree angle back behind the front face or inturned flange 17 but spaced therefrom to allow a sufficient radius at the bend that the finish will not be adversely affected. The material of the shell then continues through another 180-degree bend to form a reversed flange 63 which is cut away, as shown at 64 (see FIG. 4) in the area of the mullion for mounting of the support strap 41 and mullion cover 42. Also in this area, the material of liner 18, which normally includes a flange 19 which fits into the groove 62 between the reentrant flange 61 and reverse flange 63, is formed with a recess 66 which serves to provide a clearance space for the ends of the mullion strap 41. As shown in FIG. 5, a heater tube 67 may be positioned in the bend between reentrant flange 61 and reverse flange 63, and will be held in place by abutting contact with the strap ends 57.

When the support strap 41 is then mounted in place, outer screws 69 pass through suitable openings formed in the front face 17 and reentrant flange 61 to make a self-tapping threaded engagement with the outer holes 59 formed in the support strap. As the screws 69 are tightened, the channel-shaped end section of the mullion strap is clamped forwardly against the rear face of the reentrant flange 61 and the spurs 58 will then bite through the painted surface to establish grounding contact between the mullion strap and the shell 16. Thus, when the two outer screws 69 are secured in place, the mullion strap 41 serves as a tie rod or bar to hold the opposing sides of the shell firmly in place against flexing either outwardly or inwardly.

The mullion cover 42 has a flat finished, rectangular center section 71 adapted to provide a sealing surface for the door gaskets 27 and 28 and extends laterally between the two edges of the front face 17 and vertically a sufficient extent to both allow gasket seating and provide a cover for the partition 14. Rearwardly extending upper and lower flanges 72 and 73 extend backward toward the interior of the refrigerator from the center section 71 both to provide stiffness and rigidity for the mullion cover and to provide a finished exposed surface in this area. Likewise, vertical end flanges 74 also extend backward adjacent the edge of front face 17 for similar purposes. As shown more clearly in FIG. 6, the upper flange 72 extends into a groove 76 formed on the front edge of the freezer bottom 31 to provide a seal in this area and completely cover the interior of the partition. Likewise, the lower flange 73 extends backward beneath the insulation 34 until it is closely adjacent the front edge of the food compartment top 33. It should be noted that with the mullion cover 42 in place, the support strap 41 is completely covered and not visible to the casual glance of the user.

To hold the mullion cover in place, inner screws 78, which are preferably identical to the outer screws 69, extend through openings in the mullion cover 42 to engage the inner holes 54 at each end of the mullion strap and the tightening of screws 78 causes the serrations 56 on the flanges 47 and 48 to bite into the rear face of the mullion cover to penetrate any paint or other surface finish to ensure positive grounding contact between the mullion cover itself and, through the support strap 41, to the metal shell 16 and remainder of the refrigerator structure. It should be noted that when the screws 69 and 78 are fully tightened to pull the mullion support strap 41 and mullion cover 42 together, the mullion cover, together with the support strap web portion 49 and flanges 47 and 48, form a rigid box structure at the ends adjacent the screws 69 and 78, which are used to mount the middle hinge bracket 25. As shown in FIGS. 4 and 5, the middle hinge bracket 25 has a vertical flange 81 and a horizontal flange 82 for carrying a suitable door pintle in either .of the holes 84 adjacent the front edge. It will be understood that the doors are reversible in the sense that they may be hinged on either side for the convenience of the user and the location of the refrigerator. Thus, the inner and outer screws 78 and 69 on one side extend through the vertical flange 81 to firmly clamp the hinge bracket in place on either side of the refrigerator as desired. Since the screws 69 and 78 make threaded engagement with the holes in the support strap 41, the tightening of these screws necessarily clamps the vertical flange 81 into a rigid boxlike structure with both the support strap 41 and the mullion cover 42, and the engagement of the serrations 56 and spurs 58 ensures positive grounding of all of the members, including the hinge bracket 25.

Although the preferred embodiment of the invention has been shown and described in detail, it is recognized that various modifications and rearrangements may be made without departing from the scope of the invention as defined in the claims.

What is claimed is:

1. A refrigerator cabinet comprising a shell having side walls, a top wall, and a bottom wall, said walls defining an opening and having inturned edges defining a face around said opening, said edges including reentrant and reversed flanges forming a groove between said flanges behind said face, a liner within said shell defining a chamber and having an outwardly extending flange received within said groove, a horizontal partition within said liner separating the interior of said liner into top and bottom compartments, a mullion cover on the front face of said partition extending between the edges of said side walls, a mullion strap behind said mullion cover having an end portion at each end and a center portion interconnecting said end portions, said center portion being flat and flexible, each of said end portions extending into the adjacent groove, each of said end portions being formed as a channel having an open side adjacent said mullion cover whereby said mullion cover and said mullion strap form a rectangular box at each end.

2. A refrigerator cabinet as set forth in claim 1, including a first fastener at each side wall extending from the face into said groove and engaging the adjacent mullion strap end.

3. A refrigerator cabinet as set forth in claim 2, wherein said end portion channels include a center web and upper and lower flanges and said first fasteners make threaded engagement with said web.

4. A refrigerator cabinet as set forth in claim 3, wherein at least one of said flanges has sharp serrations to make grounding contact with both said mullion and said 5. A refrigerator cabinet as set forth in claim 4, including a second fastener at each end extending from said mullion to said mullion strap center web.

6. A refrigerator cabinet as set forth in claim 5, wherein said sharp serrations are on both said upper and lower flanges adjacent said first and second fasteners.

7. A refrigerator cabinet as set forth in claim 5, including a hinge member secured to said cabinet face by said fasteners adjacent one of said side walls.

8. A refrigerator cabinet comprising a shell having side walls, a top wall, and a bottom wall, said walls defining an opening and having inturned edges defining a front face around said opening, a liner within said shell defining a chamber and being positioned behind said face, a horizontal partition within said liner separating the interior of said liner into top and bottom compartments, a mullion cover on the front face of said partition extending between the edges of said side walls, a mullion strap mounted behind said mullion cover and having an end portion at each end and a center portion interconnecting said end portions, said center portion being flat and flexible, each of said end portions extending behind said front face, each of said end portions being formed as a channel having an open side adjacent said mullion cover whereby said mullion cover and said mullion strap form a rectangular box at each end, and fastening means securing said mullion cover to said mullion strap and said mullion strap to said shell.

9. A refrigerator cabinet as set forth in claim 8, wherein said fastening means comprises a first screw extending from said front face to said mullion strap end portion at each end.

10. A refrigerator cabinet as set forth in claim 9, wherein said fastening means includes a second screw extending from said mullion cover to said mullion strap end portion at each end.

11. A refrigerator cabinet as set forth in claim 10, including a hinge member secured to said cabinet at one of said end portions by both said first and second screws.

12. A refrigerator cabinet as set forth in claim 10, wherein said mullion strap has serrations adjacent each of said first and second screws arranged to penetrate any surface finish and make grounding contact with said shell and said mullion cover.

* * * * *

UNITED STATES PATENT AND TRADEMARK OFFICE

CERTIFICATE OF CORRECTION

PATENT NO. : 4,955,676

DATED : September 11, 1990

INVENTOR(S) : Weaver et al.

It is certified that error appears in the above-identified patent and that said Letters Patent is hereby corrected as shown below:

Column 2, line 11, delete "thIs" and insert --this--.

Column 3, line 33, delete "receIving" and insert --receiving--.

Column 7, line 34, after "said" insert --shell.--.

Signed and Sealed this

Twenty-eighth Day of January, 1992

*Attest:*

HARRY F. MANBECK, JR.

*Attesting Officer*

*Commissioner of Patents and Trademarks*